US010639226B1

(12) United States Patent
Keyes et al.

(10) Patent No.: US 10,639,226 B1
(45) Date of Patent: May 5, 2020

(54) MOBILITY ASSISTANCE APPARATUS

(71) Applicant: Koby Keyes Product Design, LLC, Carlsbad, CA (US)

(72) Inventors: Carly Keyes, Encinitas, CA (US); Jack Koby, Carlsbad, CA (US)

(73) Assignee: Koby Keyes Product Design, LLC, Carlsbad, CA (US)

( * ) Notice: Subject to any disclaimer, the term of this patent is extended or adjusted under 35 U.S.C. 154(b) by 0 days.

(21) Appl. No.: 15/900,778

(22) Filed: Feb. 20, 2018

Related U.S. Application Data

(60) Provisional application No. 62/462,878, filed on Feb. 23, 2017, provisional application No. 62/598,395, filed on Dec. 13, 2017.

(51) Int. Cl.
*A61H 3/00* (2006.01)
*A61H 3/04* (2006.01)

(52) U.S. Cl.
CPC ..... *A61H 3/04* (2013.01); *A61H 2003/006* (2013.01); *A61H 2201/0161* (2013.01); *A61H 2201/1633* (2013.01)

(58) Field of Classification Search
CPC ..... A61H 3/04; A61H 3/00
See application file for complete search history.

(56) References Cited

U.S. PATENT DOCUMENTS 4,510,956 A 4/1985 King
4,945,962 A * 8/1990 Pajtas ..... B60C 7/10 152/11
4,974,760 A * 12/1990 Miller ..... A61H 3/00 135/67
4,985,947 A 1/1991 Ethridge
5,020,560 A 6/1991 Turbeville
5,224,717 A 7/1993 Lowen
5,520,402 A 5/1996 Nestor et al.
6,338,493 B1 1/2002 Wohlgemuth et al.
6,343,802 B1 2/2002 Workman et al.
6,743,156 B1 * 6/2004 Jacques, II ..... A61H 3/04 135/65
6,942,130 B1 * 9/2005 Duva ..... A45F 3/00 135/66
7,052,030 B2 * 5/2006 Serhan ..... A61H 3/04 280/304.1
7,111,856 B1 9/2006 Graham
7,179,200 B1 2/2007 Wu
7,278,436 B2 * 10/2007 Gale ..... A45B 7/00 135/67
7,992,584 B1 8/2011 Birnbaum
8,104,524 B2 * 1/2012 Manesh ..... B60B 9/00 152/301

(Continued)

*Primary Examiner* — Hau V Phan
(74) *Attorney, Agent, or Firm* — Clause Eight IPS; Michael Catania

(57) ABSTRACT

An improved mobility assistance apparatus designed for the elderly is disclosed herein. The apparatus alleviates wrist and back strain and increases stability by distributing the users weight across his or her forearms onto a pair of armrests. The user stands centered inside of the improved mobility assistance apparatus which provides better stability in all directions, helping to keep users from falling over backwards or to the side as is common with existing walkers. The wheels of the improved mobility assistance apparatus conform to obstacles in the ground, creating a smoother walking experience.

6 Claims, 26 Drawing Sheets

(56) References Cited

U.S. PATENT DOCUMENTS

| | | | | |
|---|---|---|---|---|
| 8,166,987 | B2 | 5/2012 | Weaver | |
| 8,176,957 | B2 | 5/2012 | Manesh et al. | |
| 8,251,079 | B1 * | 8/2012 | Lutz | A61H 3/04 135/67 |
| 8,434,780 | B2 | 5/2013 | Li | |
| 8,468,622 | B2 | 6/2013 | Purwar et al. | |
| 8,540,256 | B1 | 9/2013 | Simpson | |
| 8,596,658 | B1 | 12/2013 | Dashew et al. | |
| D699,634 | S * | 2/2014 | Wu | D12/130 |
| 8,708,363 | B1 * | 4/2014 | Chang | A61H 3/04 135/67 |
| 8,720,914 | B1 * | 5/2014 | Heath | A61H 3/04 135/67 |
| 8,740,242 | B2 | 6/2014 | Slomp | |
| 8,944,125 | B2 | 2/2015 | Manesh et al. | |
| 9,022,397 | B1 * | 5/2015 | Prettyman | B62B 5/0447 280/47.34 |
| 9,314,395 | B1 * | 4/2016 | VanAusdall | A61H 3/04 |
| 9,387,726 | B2 * | 7/2016 | Choi | B60C 7/18 |
| 9,566,207 | B1 | 2/2017 | Ratliff | |
| 9,585,807 | B2 | 3/2017 | Fellingham et al. | |
| 9,597,251 | B2 * | 3/2017 | Liles | A61H 3/04 |
| 9,662,264 | B2 * | 5/2017 | Jacobs | A61H 3/04 |
| 2011/0232665 | A1 * | 9/2011 | Barnett, Jr. | A45B 7/00 132/200 |
| 2015/0320633 | A1 * | 11/2015 | Jacobs | A61H 3/04 297/6 |
| 2016/0157951 | A1 * | 6/2016 | Schoenig | A61G 7/0503 280/830 |
| 2016/0200145 | A1 * | 7/2016 | Asper | B29D 30/02 152/11 |
| 2017/0209331 | A1 | 7/2017 | Scherr | |

* cited by examiner

20

20

20

20

20

20

MOBILITY ASSISTANCE APPARATUS

CROSS REFERENCE TO RELATED APPLICATION

The Present Application claim priority to U.S. Provisional Patent Application No. 62/462,878, filed on Feb. 23, 2017, and U.S. Provisional Patent Application No. 62/598,395, filed on Dec. 13, 2017, both of which are hereby incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present invention generally relates to walkers for individuals.

Description of the Related Art

As people grow old it becomes increasingly hard for them to move. Walking, however, is extremely important for elderly people's quality of life. Being able to walk allows elderly people to be more independent in every way from visiting friends, to attending doctors appointments, to simply getting out of bed and going to the bathroom without assistance.

Elderly people suffer from arthritis and lack of balance, meaning they need mobility aids to properly support them while they walk. A mobility aide must also be comfortable enough to use regularly without creating additional health problems or exacerbating joint pain. We found that many of the existing options don't offer sufficient support for walking independently. They are also extremely uncomfortable to use, resulting in wrist strain and backaches. We wanted to create a walker that would comfortably allow elderly people to continue walking later in life.

The prior art discusses various mobility assistance apparatuses, such as walkers.

A person using a walker is usually arched over, places pressure on the handles of the walker resulting in strain on the wrist of the person, and the walker does not generally provide that much support to the person.

The walker is typically used in front of the person.

Most walker wheels are small in diameter and composed of a hard plastic material. Getting over a bump is difficult due to this small wheel diameter and unforgiving plastic material.

Walker wheels don't generate heat.

BRIEF SUMMARY OF THE INVENTION

The present invention is an improved mobility assistant apparatus designed for the elderly. It alleviates wrist and back strain and increases stability by distributing the users weight across his or her forearms onto a pair of armrests. The user stands centered inside of the improved mobility assistant apparatus which provides better stability in all directions, helping to keep users from falling over backwards or to the side as is common with existing walkers. The wheels of the improved mobility assistant apparatus conform to obstacles in the ground, creating a smoother walking experience. The improved mobility assistant apparatus also offers a fold down seat and accessible storage bag.

One aspect of the present invention is a mobility assistance apparatus. The apparatus comprises a first handle at an angle relative to an arm rest, a first arm rest, a second handle, a second arm rest, a first adjustable bar, a second adjustable bar, a main frame comprising a crossbar, a first down bar, a second down bar, a first seat tab, a second seat tab, a first lower tab, a second lower tab, a first caster receiver, and a second caster receiver, a seat component comprising a first arm connected to the first seat tab, a second arm connected to a second seat tab, a cross bar connected to the first arm and the second arm, and a padded seat positioned on the cross bar, a first rear bar connected to the first lower tab, a second rear bar connected to the second lower tab, the second rear bar parallel to the first rear bar, a first front fork connected to the first caster receiver, a second front fork connected to the second caster receiver, a first wheel assembly comprising a hub and a low-impact tire surrounding the hub, the hub connected to first front fork, a second wheel assembly comprising a hub and a low-impact tire surrounding the hub, the hub connected to second front fork, a third wheel assembly comprising a hub and a low-impact tire surrounding the hub, the hub connected to first rear bar, a fourth wheel assembly comprising a hub and a low-impact tire surrounding the hub, the hub connected to second rear bar. A user is positioned within the first rear bar and the second rear bar when using the apparatus. The user's arms rest on the first arm rest and the second arm rest when using the apparatus. The apparatus traverses small obstacles due to the first wheel assembly, the second wheel assembly, the third wheel assembly and the fourth assembly.

Another aspect of the present invention is a mobile apparatus comprising a frame and a plurality of wheel assemblies, each of the wheel assemblies comprising a hub and a low impact tire, the hub connected to the frame.

Yet another aspect of the present invention is a wheel for a mobile apparatus. The wheel comprises a hub and a low impact tire.

A height between a first wheel assembly and a first arm rest preferably ranges from 28 inches to 44 inches.

The apparatus preferably comprises at least one of aluminum tubing, cast aluminum or an injection molded polymer.

A length of each of the first rear bar and the second rear bar is preferably approximately 18 inches.

A length of each of the first arm rest and the second arm rest is preferably approximately 11.5 inches.

A thickness of each of the first arm rest and the second arm rest is preferably approximately 0.75 inch.

A length of each of the first handle and the second handle is preferably approximately five inches.

A diameter of each of the first handle and the second handle is preferably approximately 1.5 inches.

A diameter of each of the low impact tire of the first wheel assembly, the second wheel assembly, the tire wheel assembly and the fourth wheel assembly is preferably approximately 7 inches.

A width of each of the low impact tire of the first wheel assembly, the second wheel assembly, the tire wheel assembly and the fourth wheel assembly is preferably approximately 1.5 inches.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 26:
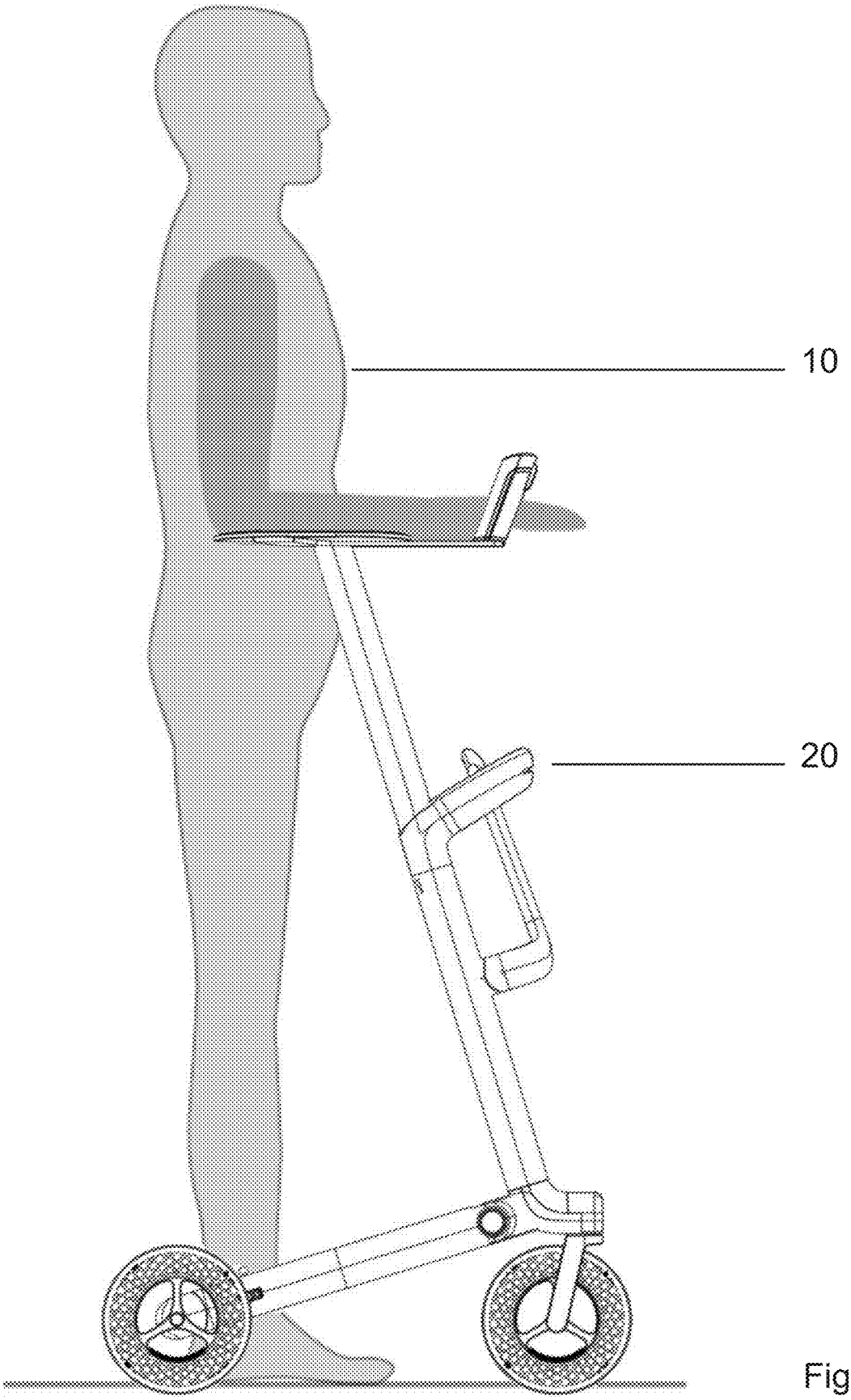
FIG. 26 is an illustration of a user walking with the mobility assistance apparatus.

As shown in the FIGS. 1-26, the present invention is an improved mobility assistant apparatus 20. FIG. 26 shows a user 10 in the mobility assistance apparatus 20.

Figure 1:
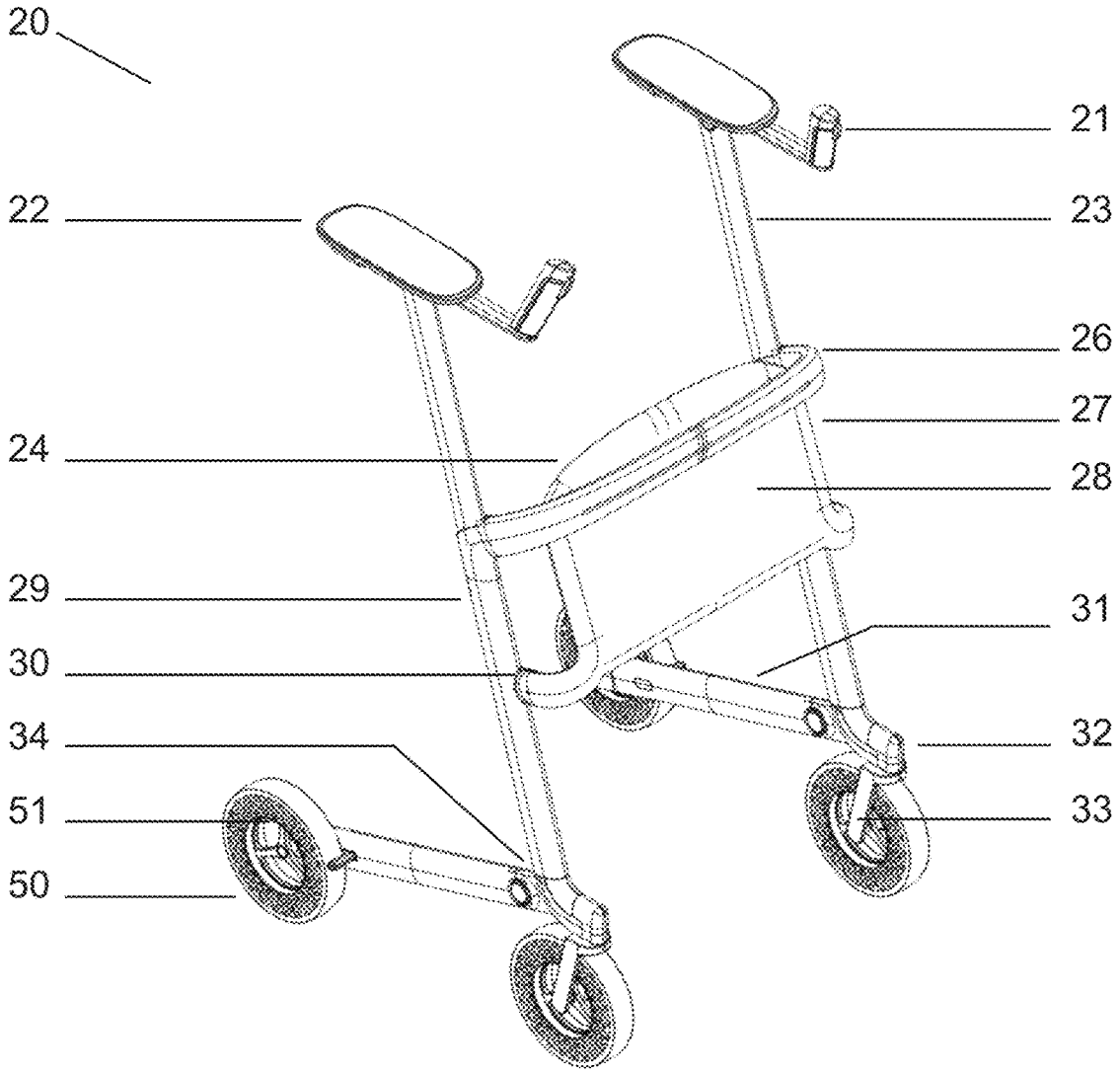
FIG. 1 is a top perspective view of a mobility assistance apparatus in a standing position.
Figure 2:
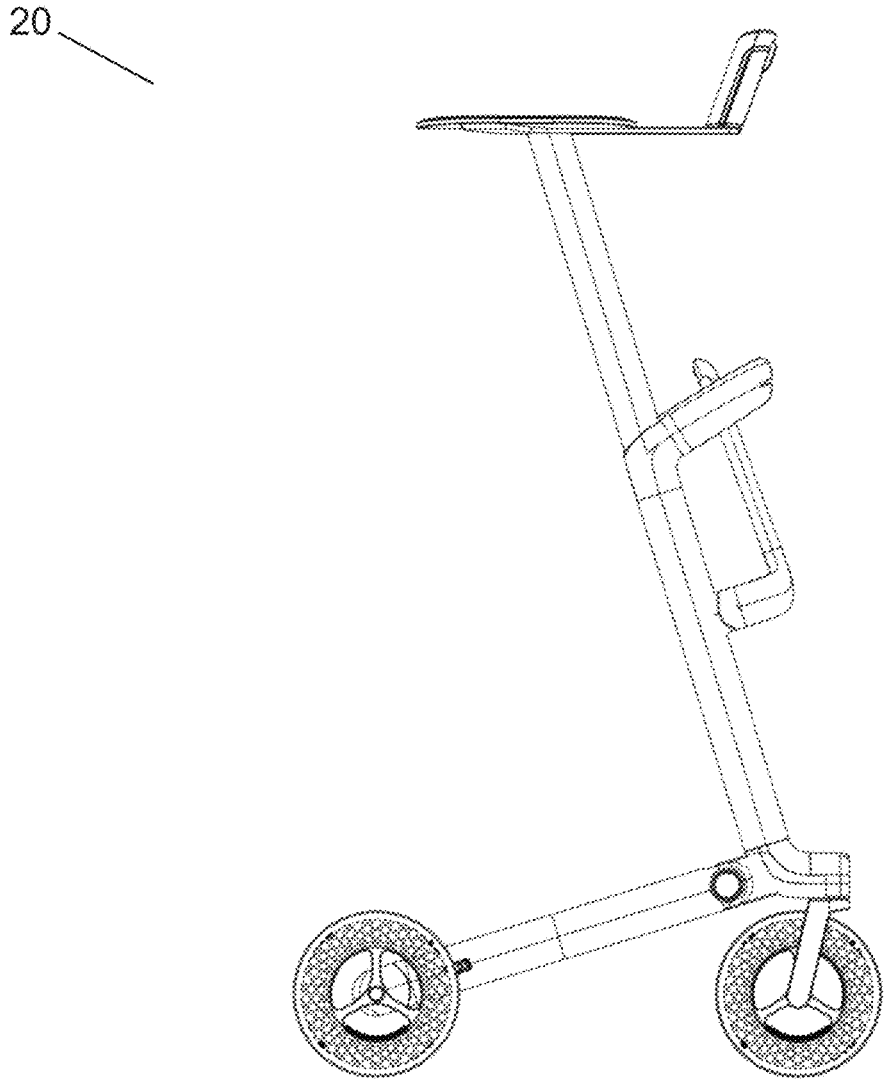
FIG. 2 is a side elevation view of a mobility assistance apparatus in a standing position.
Figure 3:
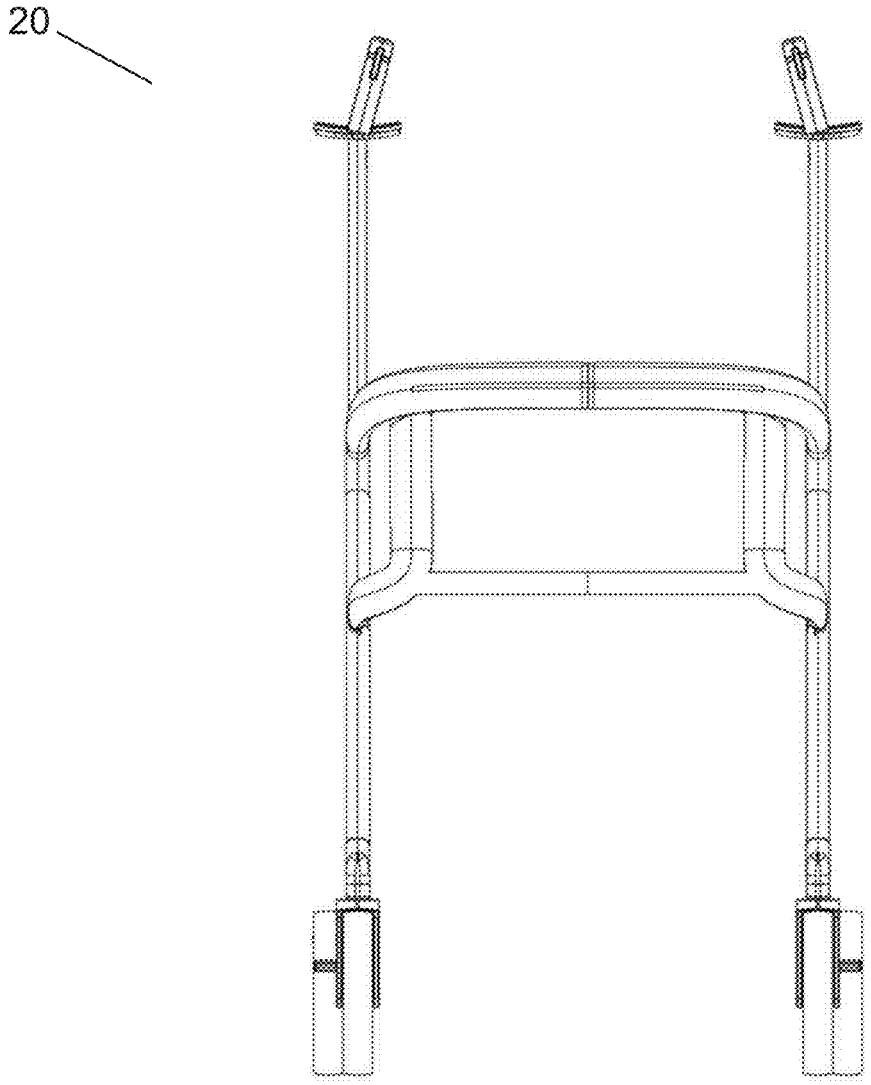
FIG. 3 is a front elevation view of a mobility assistance apparatus in a standing position.
Figure 4:
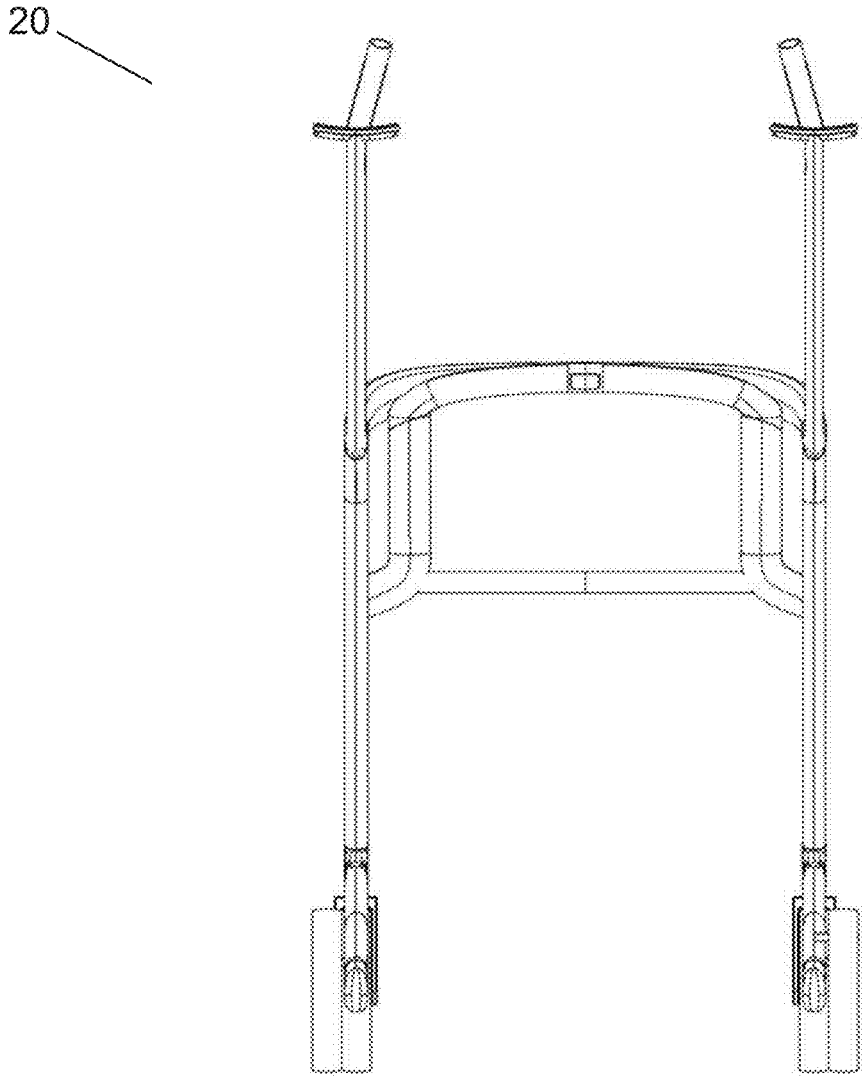
FIG. 4 is a rear elevation view of a mobility assistance apparatus in a standing position.
Figure 5:
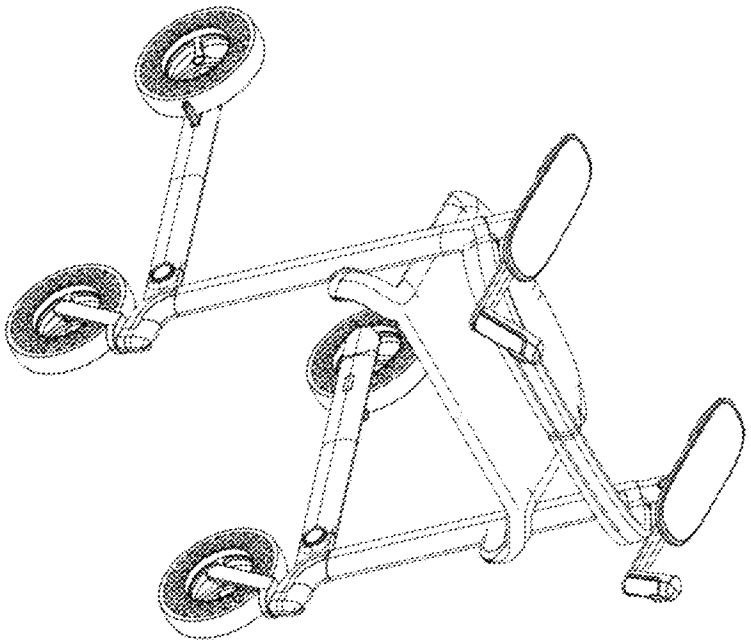
FIG. 5 is a top perspective view of a mobility assistance apparatus in a seated position.
Figure 6:
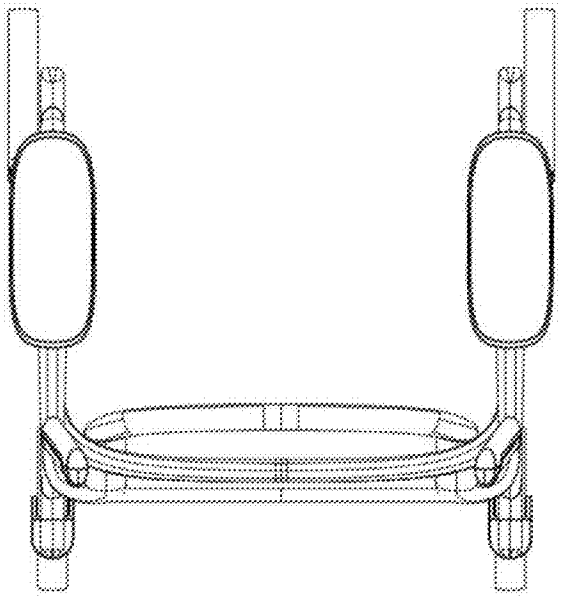
FIG. 6 is a top plan view of a mobility assistance apparatus in a standing position.
Figure 7:
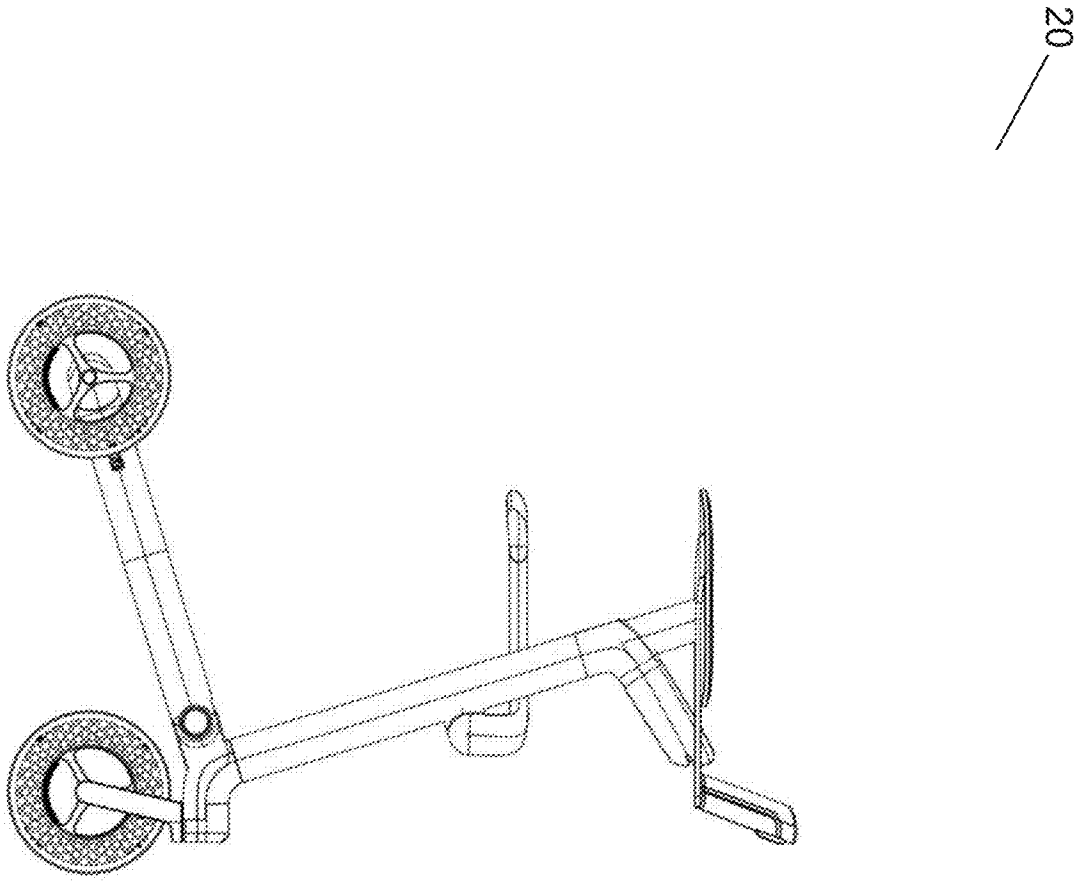
FIG. 7 is a side elevation view of a mobility assistance apparatus in a seated position.
Figure 8:
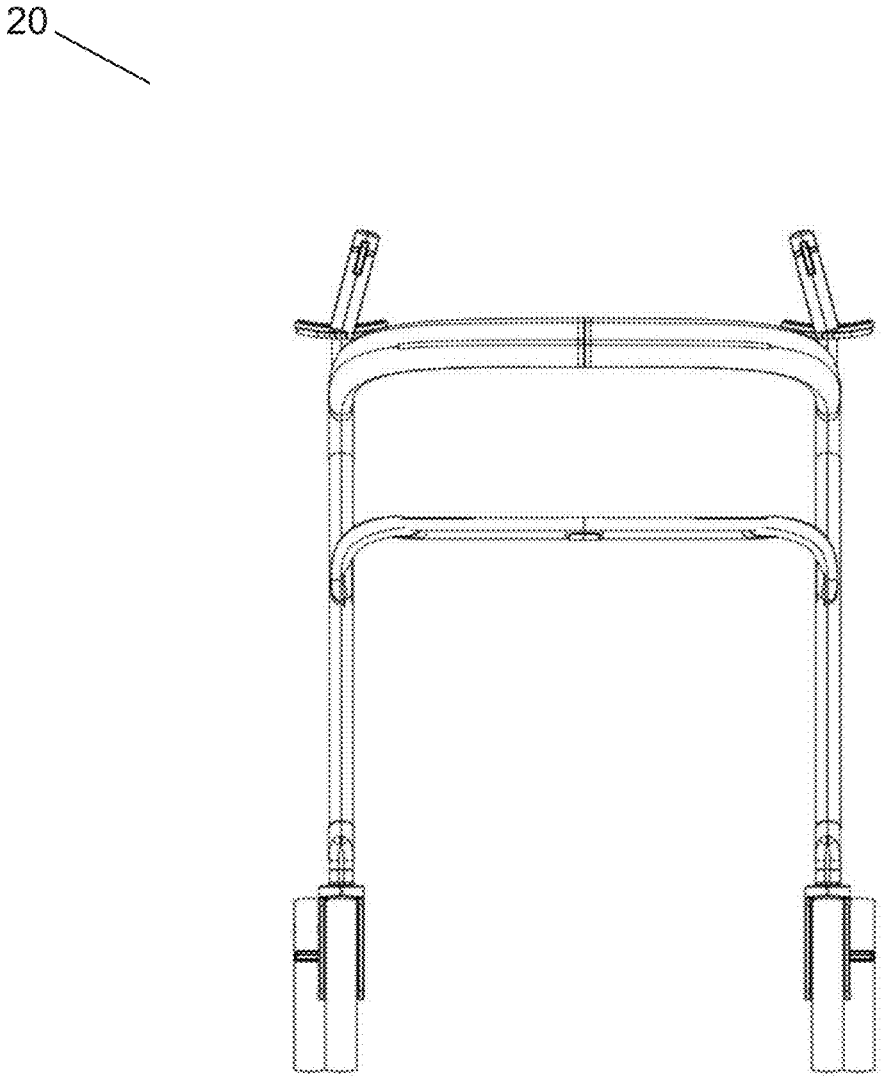
FIG. 8 is a front elevation view of a mobility assistance apparatus in a seated position.
Figure 9:
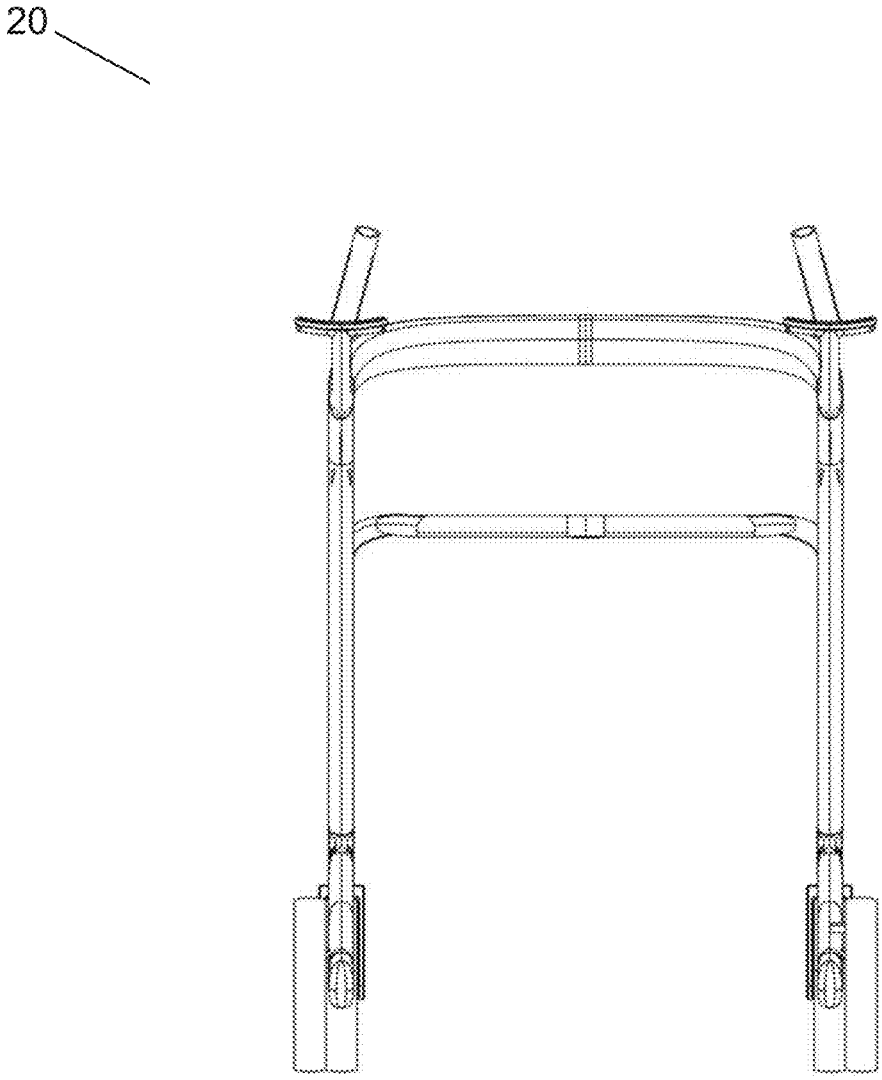
FIG. 9 is a rear elevation view of a mobility assistance apparatus in a seated position.
Figure 10:
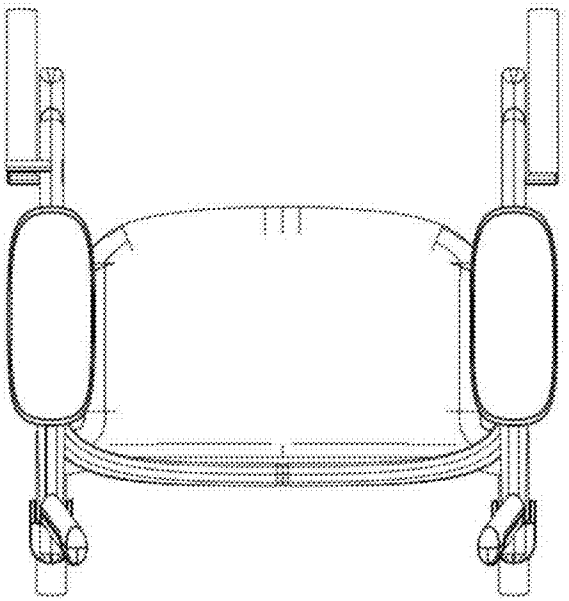
FIG. 10 is a top plan view of a mobility assistance apparatus in a seated position.
Figure 11:
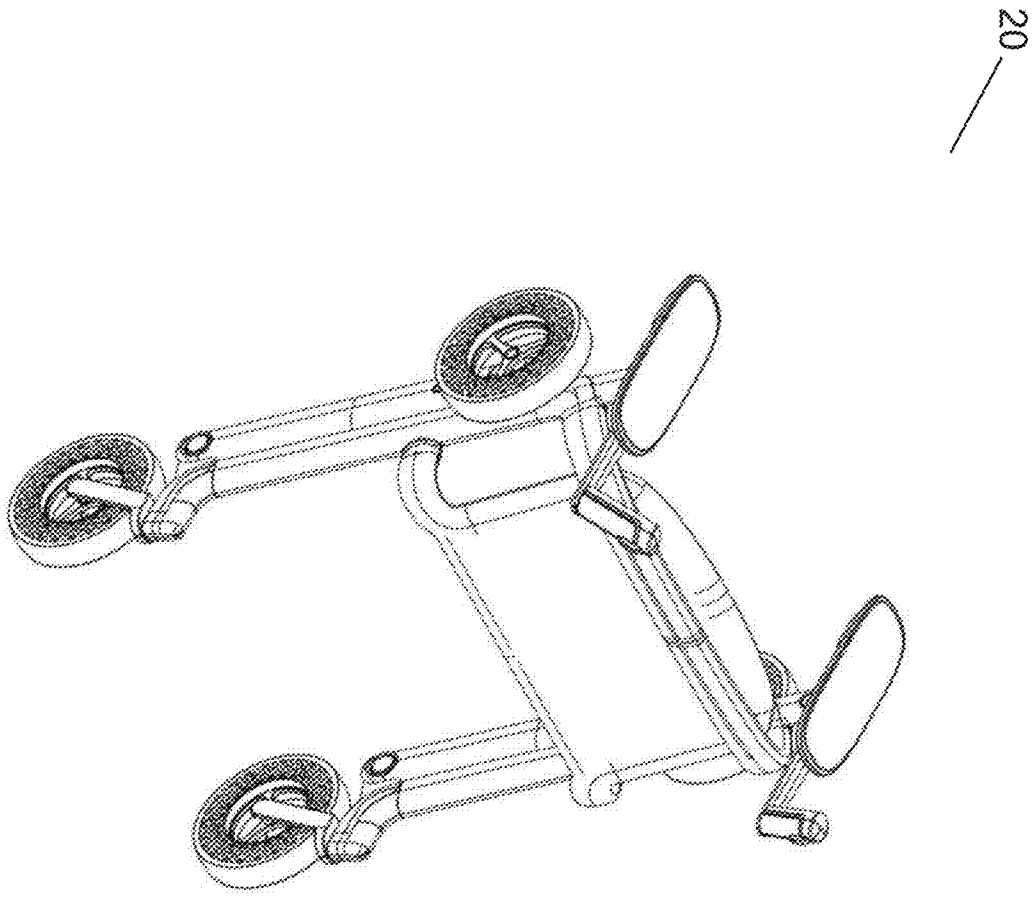
FIG. 11 is a top perspective view of a mobility assistance apparatus in a folded position.
Figure 12:
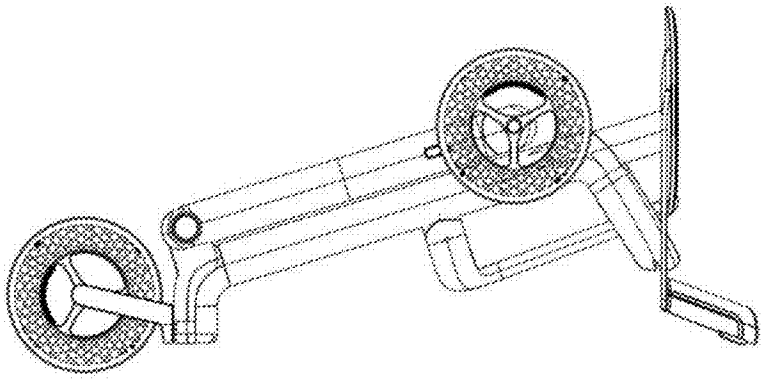
FIG. 12 is a side elevation view of a mobility assistance apparatus in a folded position.
Figure 13:
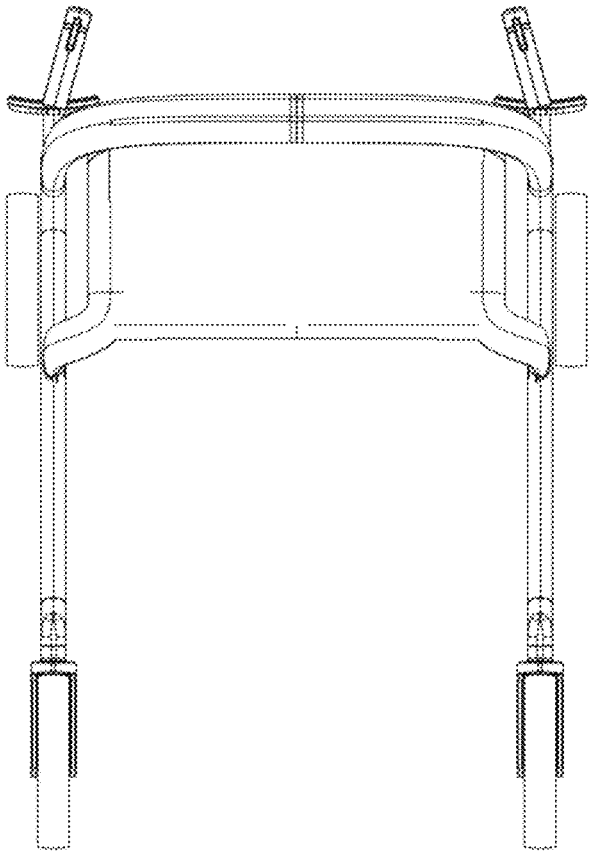
FIG. 13 is a front elevation view of a mobility assistance apparatus in a folded position.
Figure 14:
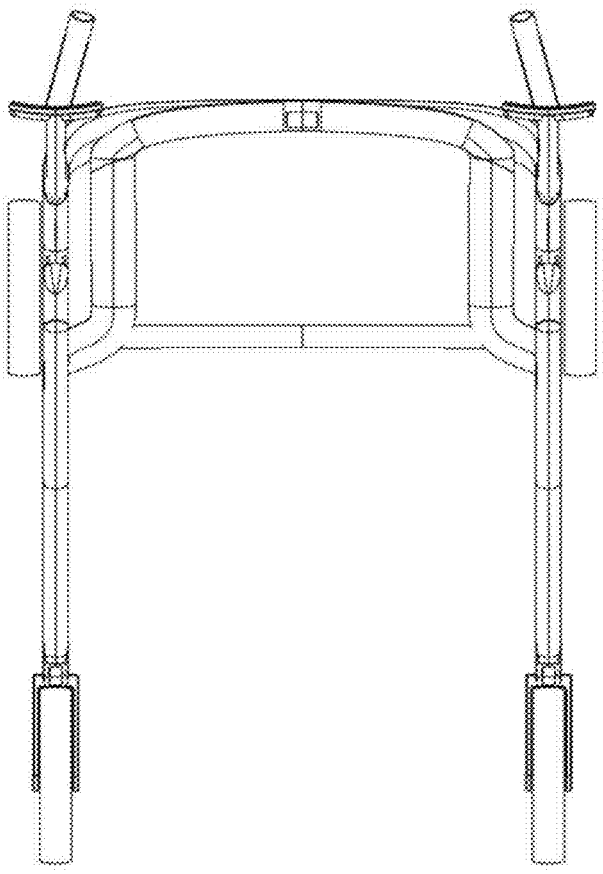
FIG. 14 is a rear elevation view of a mobility assistance apparatus in a folded position.
Figure 15:
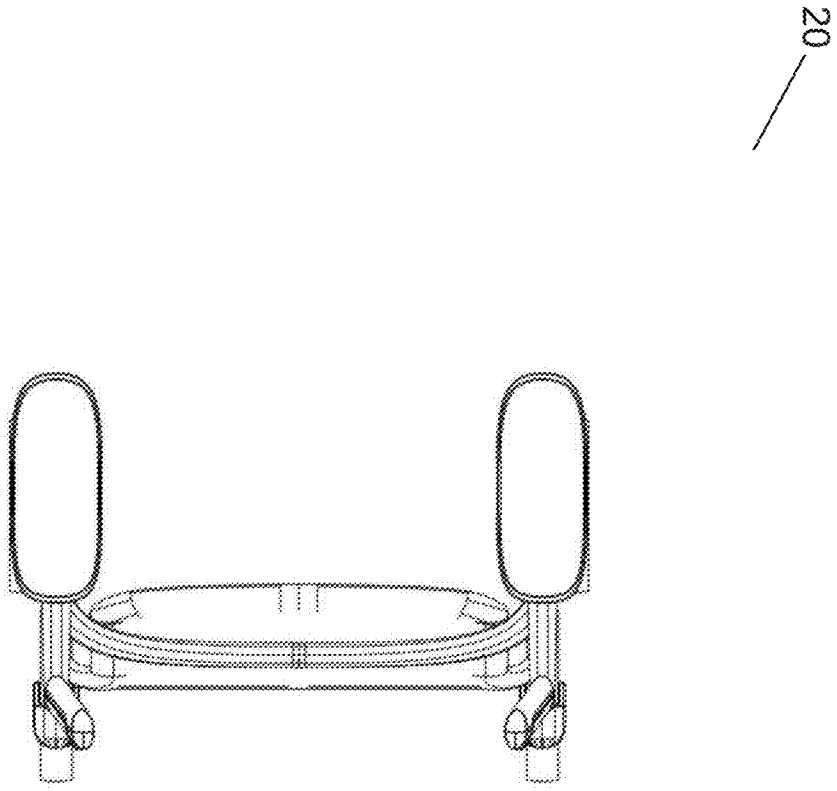
FIG. 15 is a top pan view of a mobility assistance apparatus in a folded position.
Figure 16:
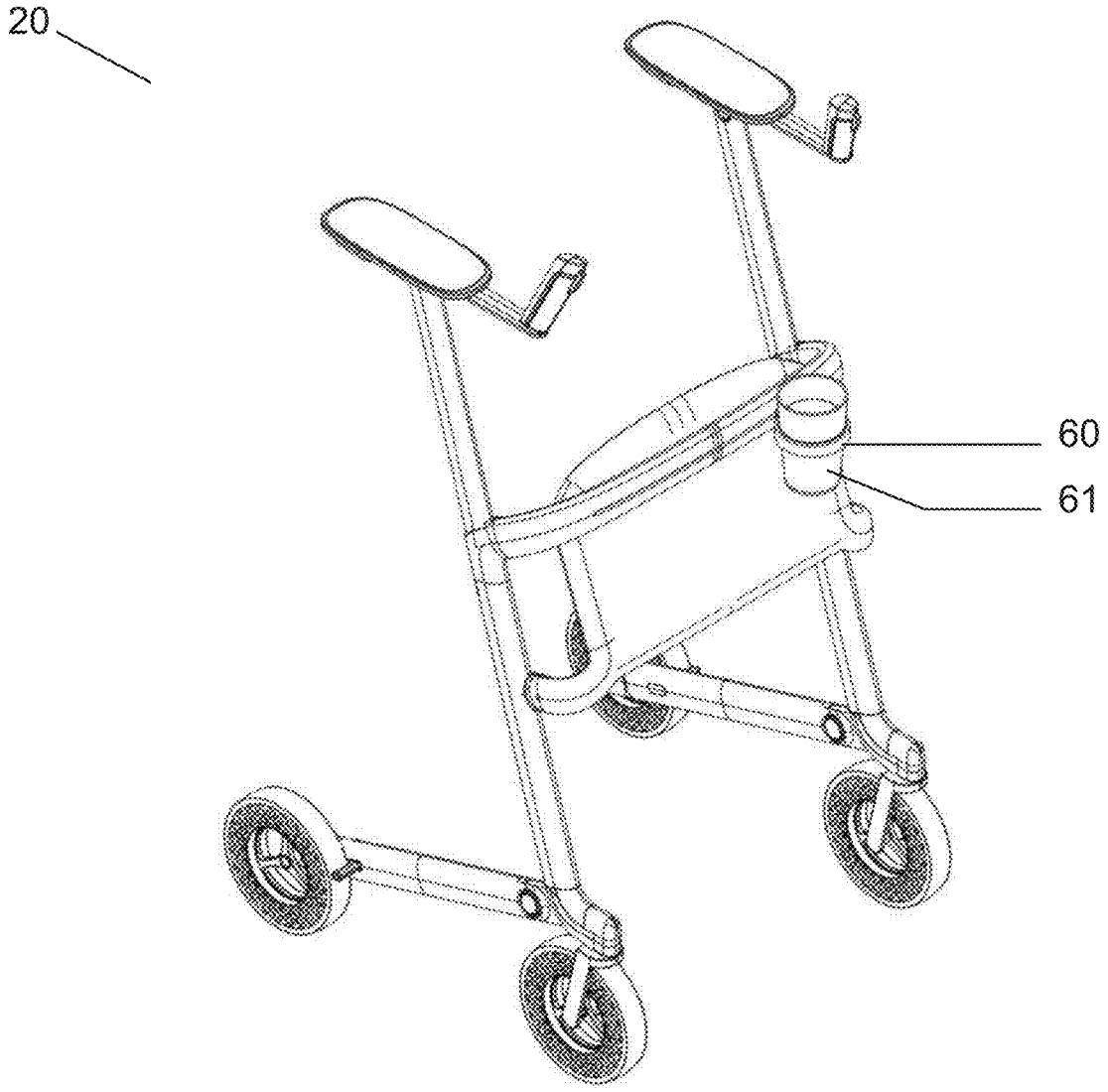
FIG. 16 is a top perspective view of a mobility assistance apparatus with a cup holder accessory.
Figure 17:
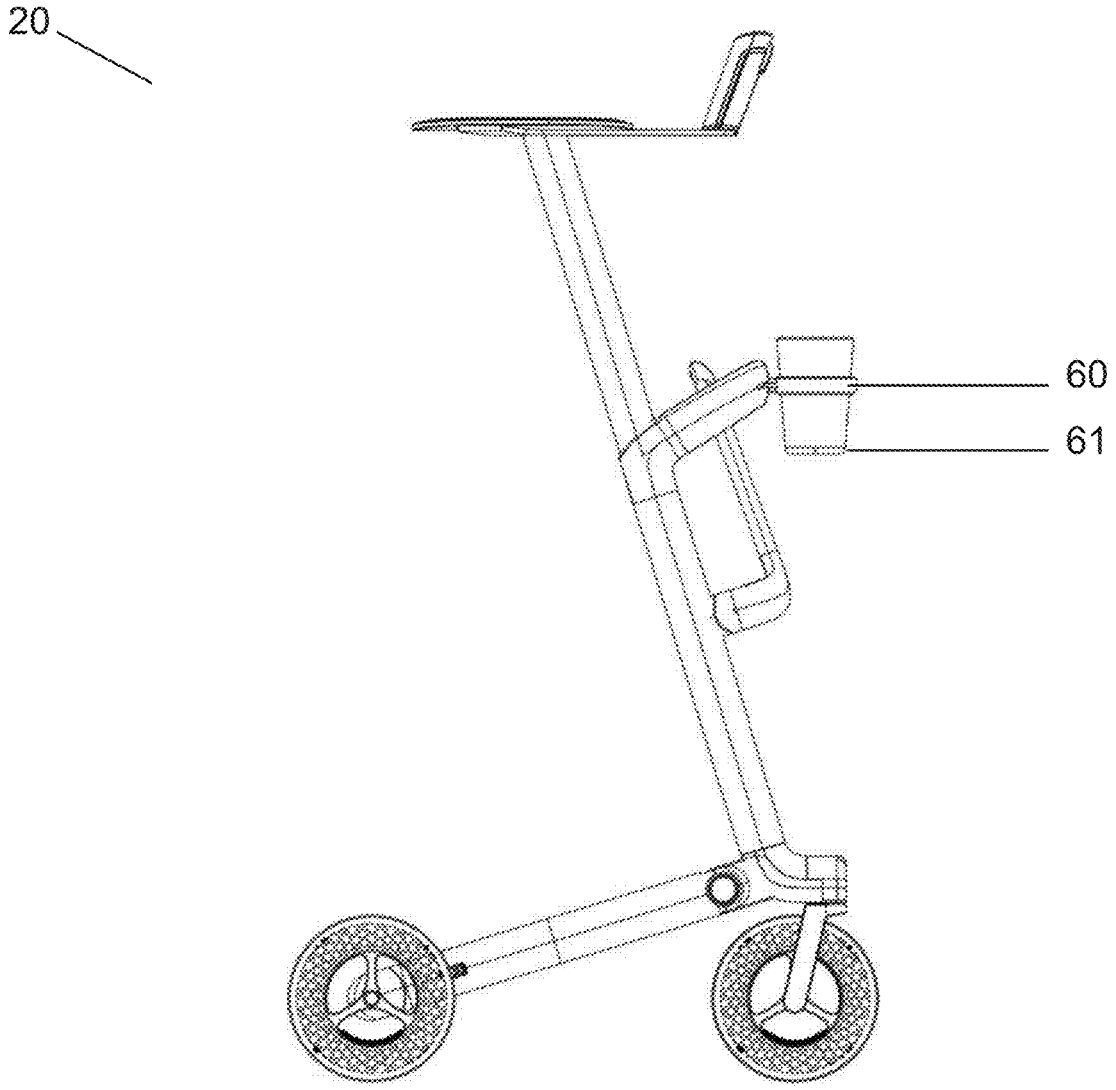
FIG. 17 is side elevation view of a mobility assistance apparatus with a cup holder accessory.
Figure 18:
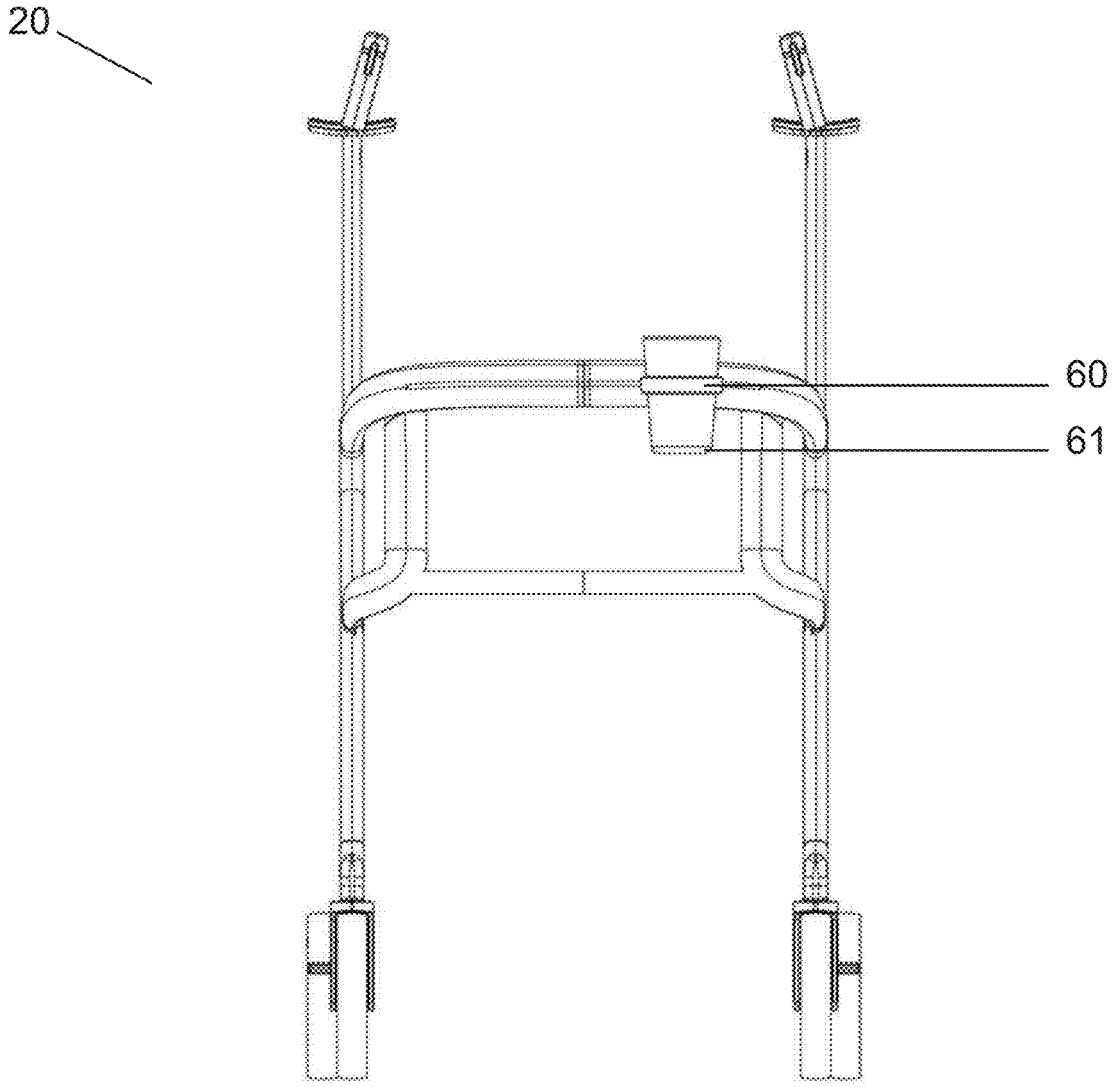
FIG. 18 is a front elevation view of a mobility assistance apparatus with a cup holder accessory.
Figure 19:
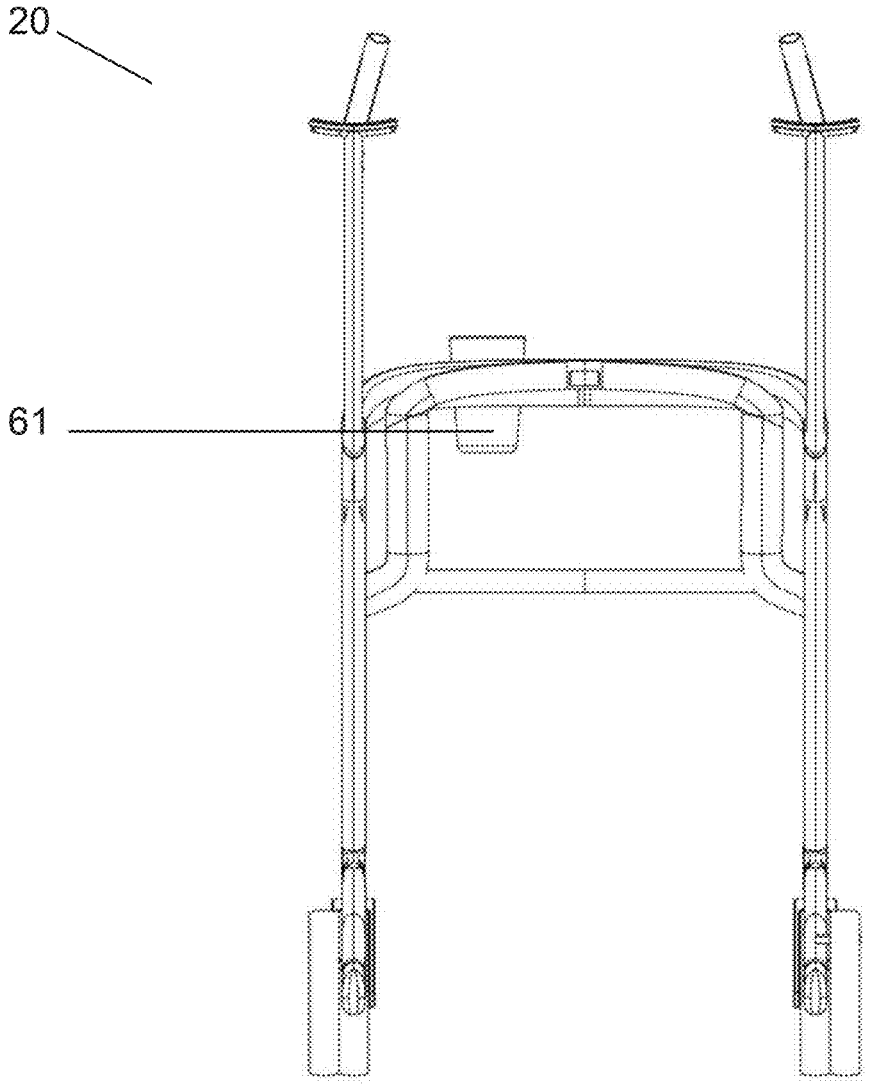
FIG. 19 is a rear elevation view of a mobility assistance apparatus with a cup holder accessory.
Figure 20:
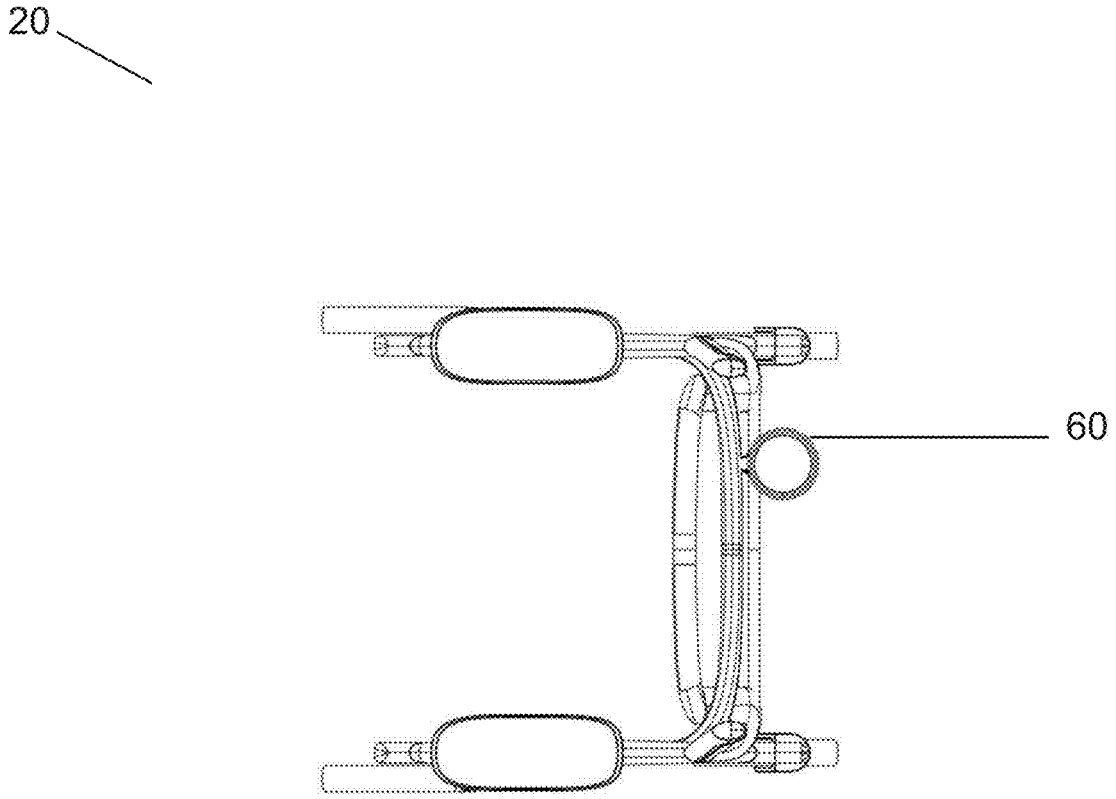
FIG. 20 is a top pan view of a mobility assistance apparatus with a cup holder accessory.
Figure 21:
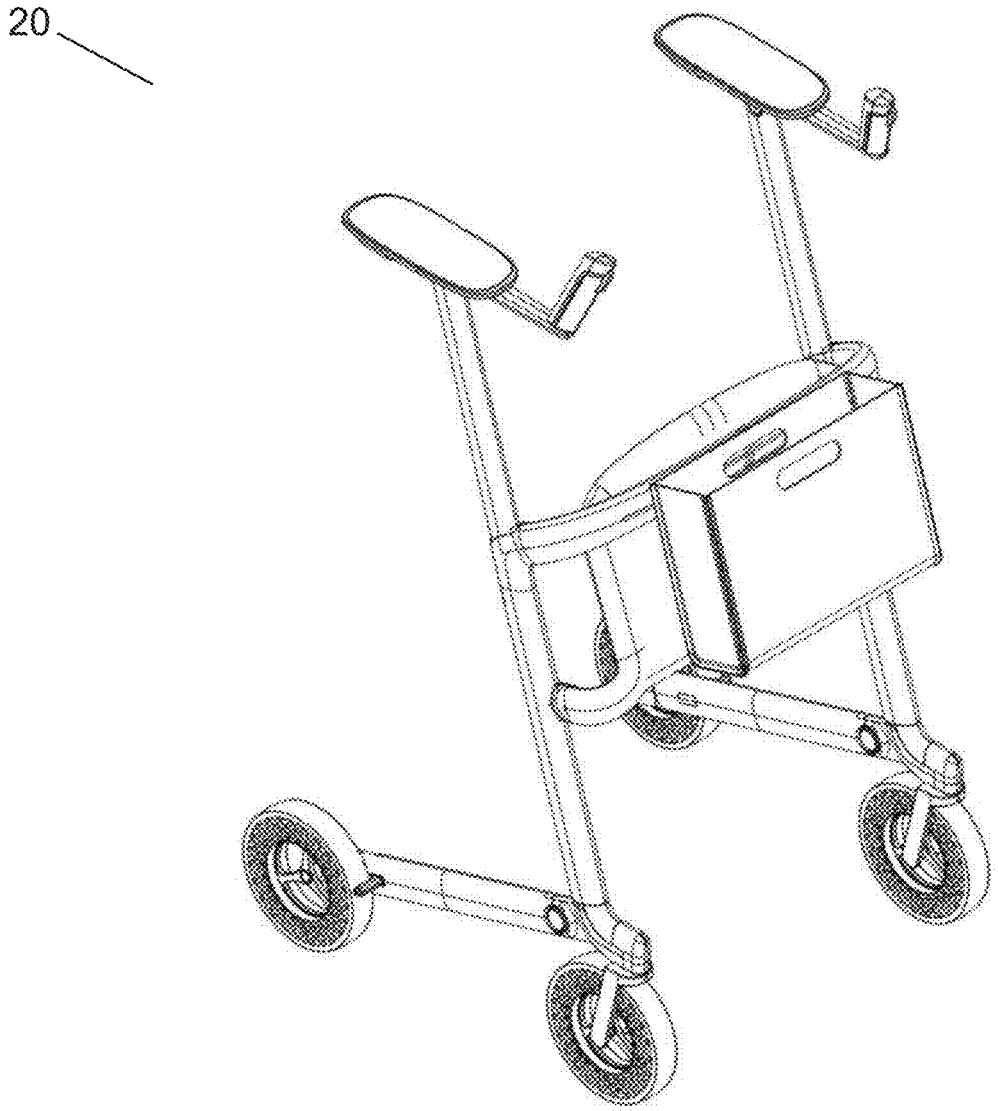
FIG. 21 is a top perspective view of a mobility assistance apparatus with a basket accessory.
Figure 22:
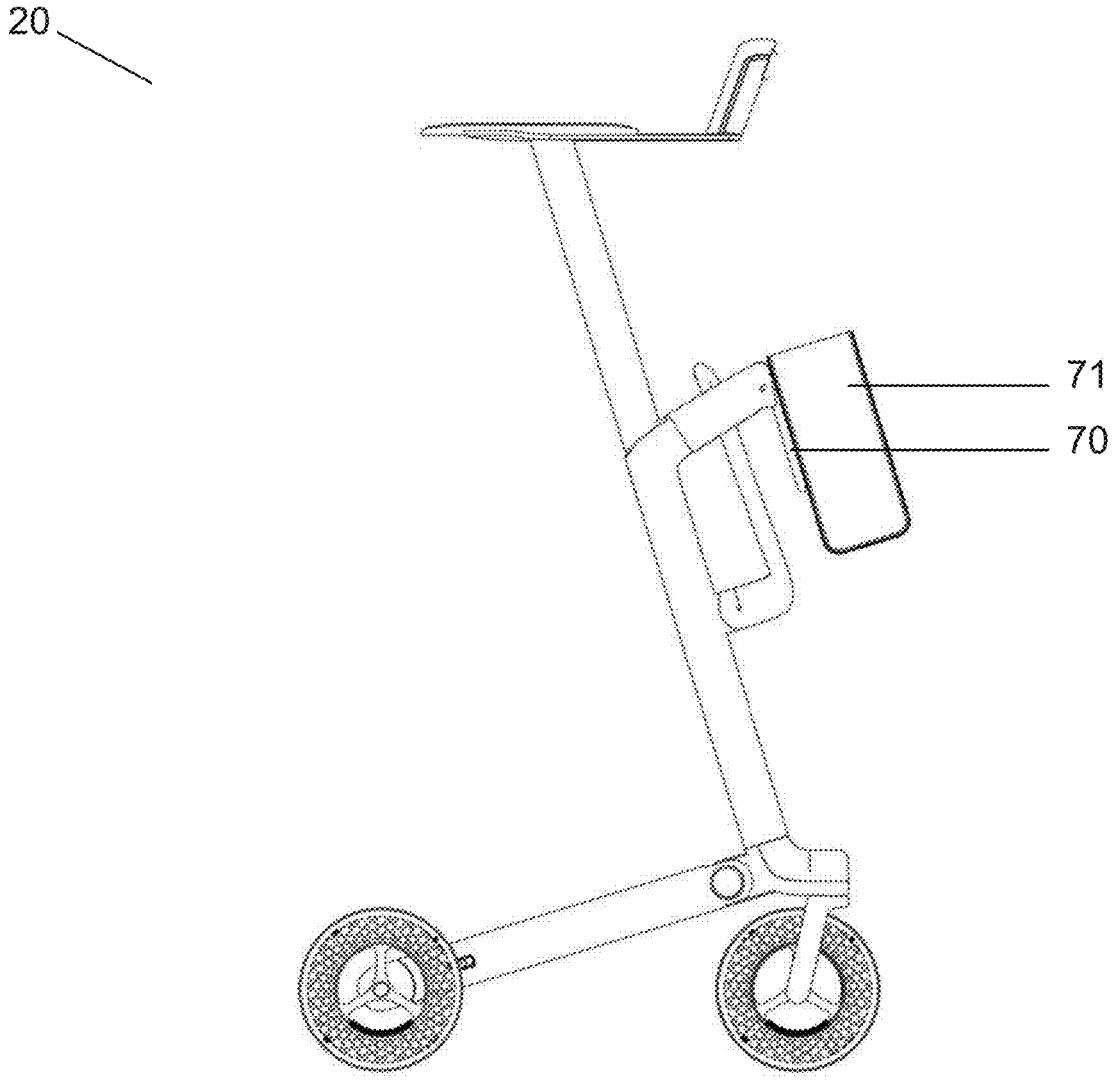
FIG. 22 is side elevation view of a mobility assistance apparatus with a basket accessory.
Figure 23:
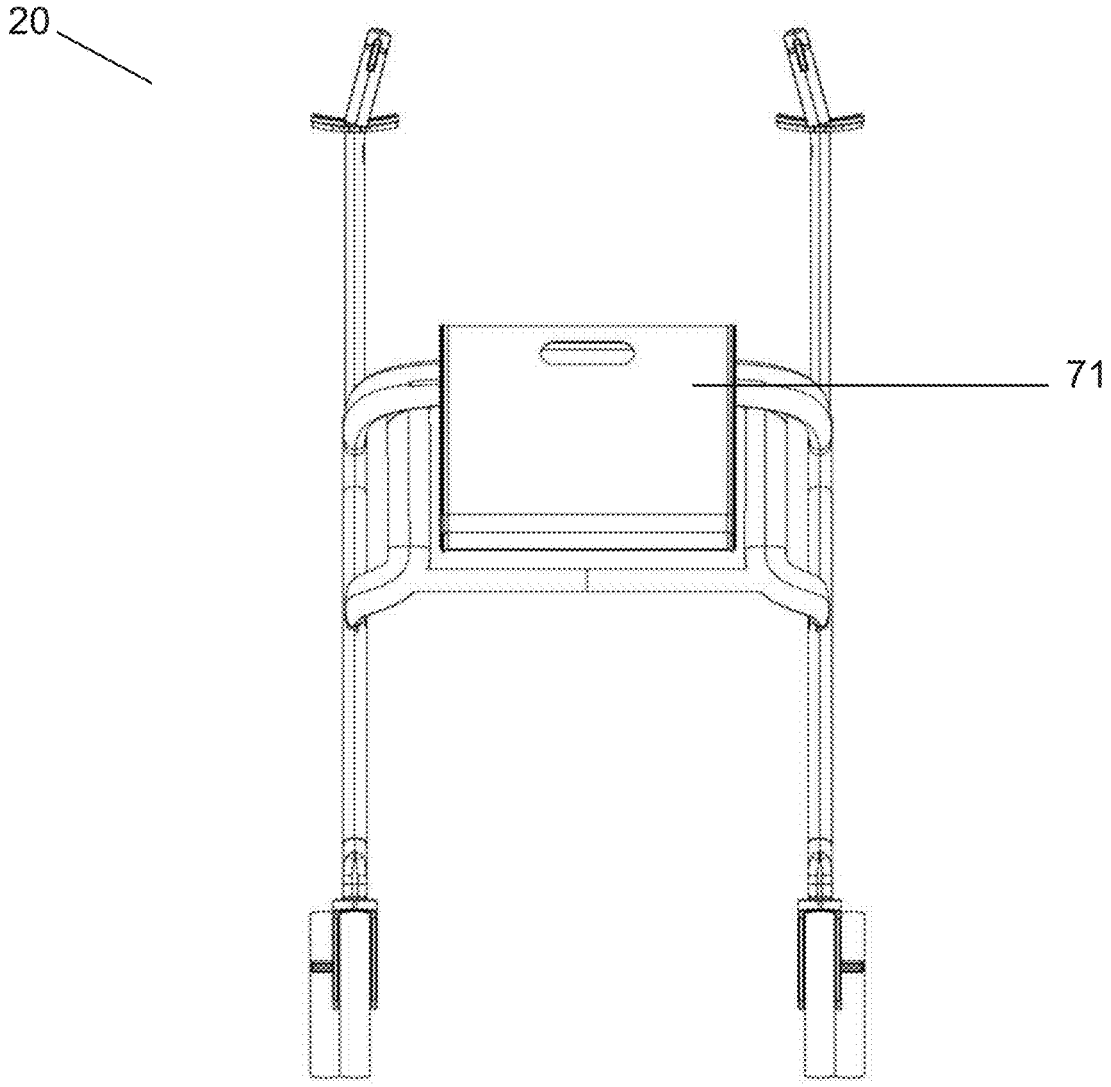
FIG. 23 is a front elevation view of a mobility assistance apparatus with a basket accessory.
Figure 24:
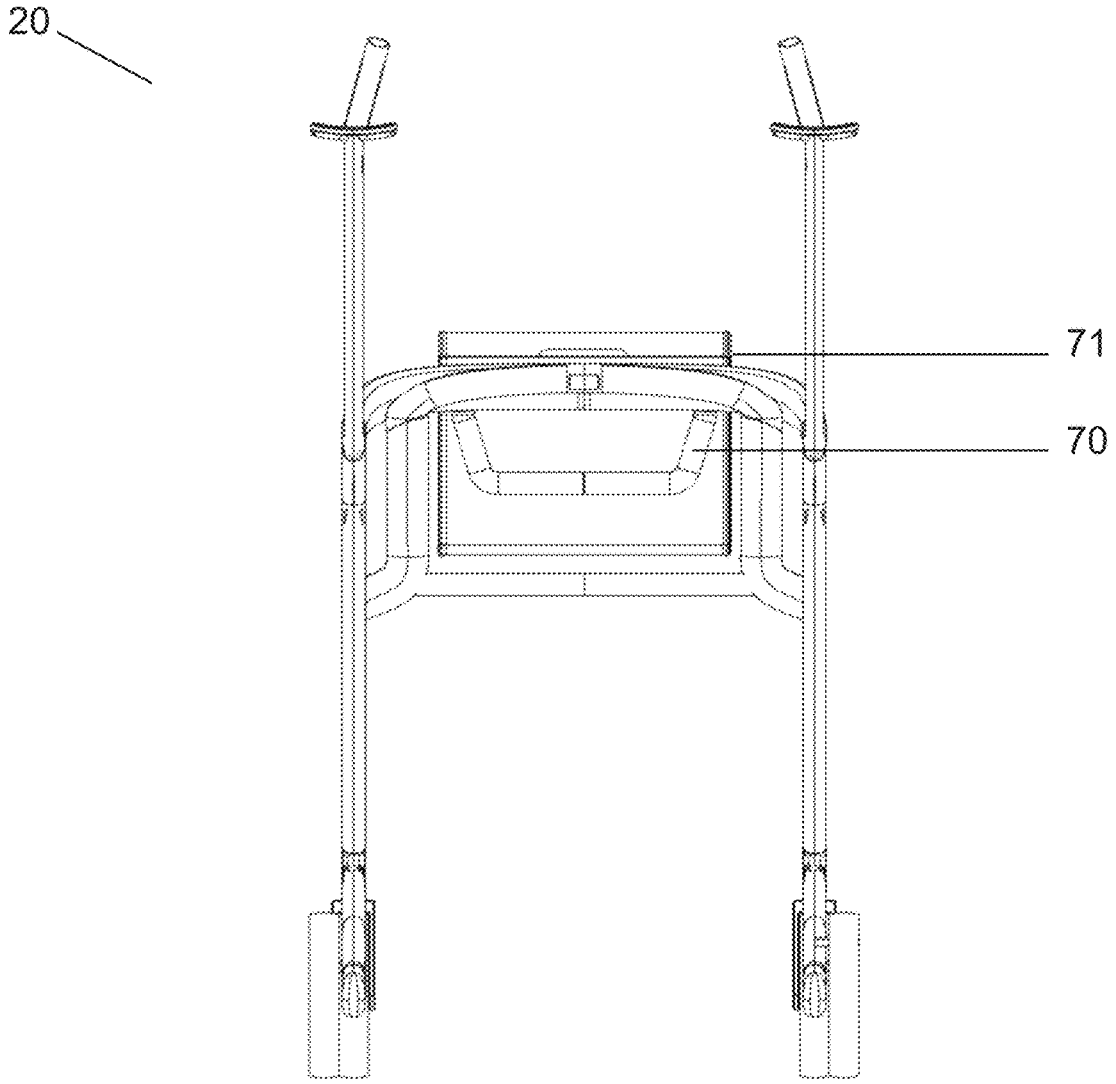
FIG. 24 is a rear elevation view of a mobility assistance apparatus with a basket accessory.
Figure 25:
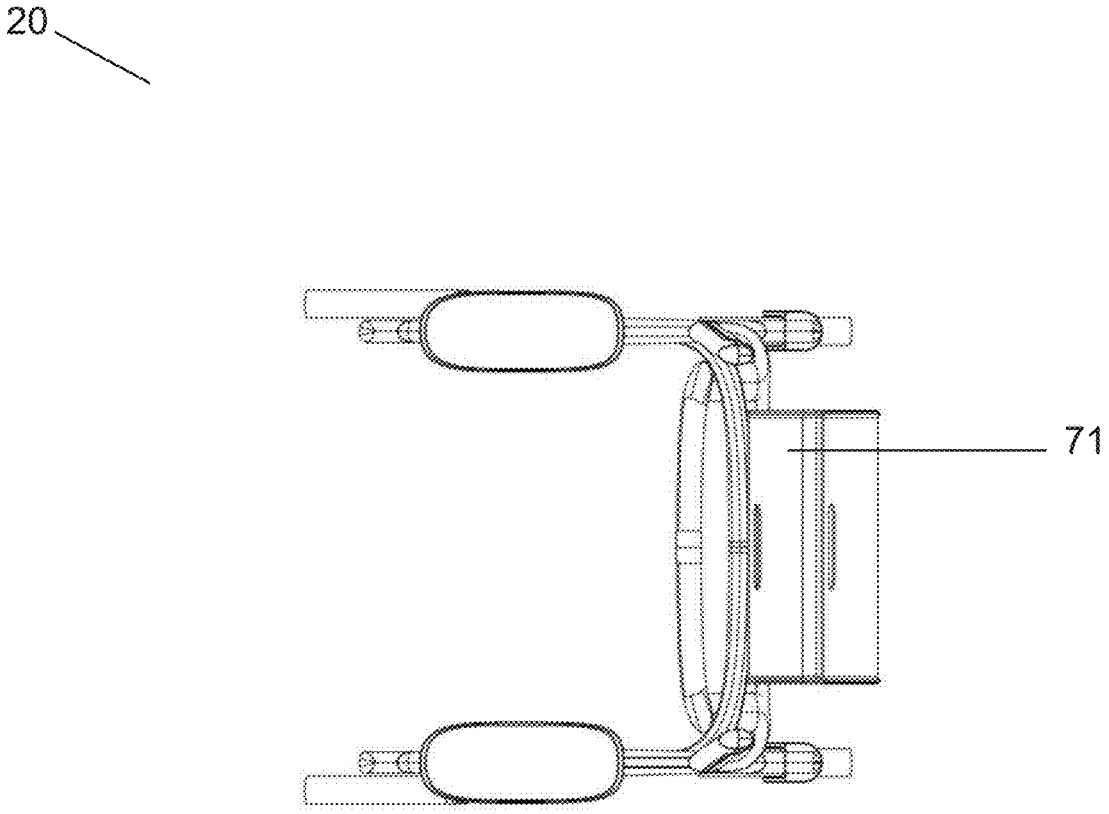
FIG. 25 is a top pan view of a mobility assistance apparatus with a basket accessory.

As shown in FIG. 1, the apparatus 20 comprises a first handle 21 at an angle relative a first arm rest 22, a second handle 21, a second arm rest 22, a first adjustable bar 23, a second adjustable bar 23, a main frame 24 comprising a crossbar 26, a first down bar 29, a second down bar 29, a first seat tab 30, a second seat tab 30, a first lower tab 34, a second lower tab 34, a first caster receiver 32, and a second caster receiver 32, a seat component comprising a first arm 27 connected to the first seat tab 30, a second arm 27 connected to a second seat tab 30, a cross bar 24 connected to the first arm 27 and the second arm 27, and a padded seat 28 positioned on the main frame 24, a first rear bar 31 connected to the first lower tab 34, a second rear bar 31 connected to the second lower tab 34, the second rear bar 31 parallel to the first rear bar 31, a first front fork 33 connected to the first caster receiver 32, a second front fork 33 connected to the second caster receiver 32, a first wheel assembly 50 comprising a hub 51 and a low-impact tire surrounding the hub 51, the hub 51 connected to first front fork 33, a second wheel assembly 50 comprising a hub 51 and a low-impact tire surrounding the hub 51, the hub 51 connected to second front fork 33, a third wheel assembly 50 comprising a hub 51 and a low-impact tire surrounding the hub 51, the hub 51 connected to first rear bar 31, a fourth wheel assembly 50 comprising a hub 51 and a low-impact tire surrounding the hub 51, the hub 51 connected to second rear bar 31.

The improved mobility assistant apparatus 20 offers increased stability for elderly people while being comfortable to use. While using the improved mobility assistant apparatus 20, one preferably stands centered in-between the four wheels 50 of the apparatus 20. This is primarily to increase stability, but helps users maneuver the apparatus 20 through tight spaces. A pair of armrests 22 allow users to distribute their weight evenly across their entire forearm resulting in less stress on any single point. No weight is placed on the users' wrists where elderly people usually experience arthritis. The cupped armrests 22 help users balance in all directions, making them less likely to fall over backwards or to the side. The armrests 22 are adjustable, allowing users to place them in the spot that is most comfortable for them. Ergonomic hand grips are used for braking and stabilizing the user.

The improved mobility assistant apparatus 20 uses uniquely designed wheels 50 to absorb obstacles, creating a smoother and uninterrupted walking experience. The wheels 50 preferably have a honeycomb structure, created from medium-density rubber, which allows them to seamlessly conform and pass over obstacles in the ground without hesitation. The flexible wheels 50 contact the ground over a larger area than traditional wheels increasing stability for the user.

The improved mobility assistant apparatus 20 is height adjustable, allowing it to be used by a wide range of people. Uniquely, the armrests 22 can also be adjusted far enough down to act as armrests 22 while the user is seated. This offers more security to those in the seat 28, and provides a stable surface to help the user sit down or stand up.

Most walkers must be gripped at an uncomfortable angle and pushed out in from of the user. Existing walkers do not provide any lateral support, leaving users vulnerable to falling sideways or backwards. Furthermore, to gain support in front of them, users must hunch over and grip current walkers at an awkward angle. When force is applied to the wrists at this angle, as it would be to prevent a fall, it causes wrist pain, especially for those with arthritis. Moreover, these walkers exacerbate bad posture by making the user hunch over to use them. The present invention solved these problems by supporting the users weight with a pair of armrests 22 that allow users to distribute their weight across their entire forearm instead of pin-pointing it on their wrists. While armrest supports do exist in a small number of gate trainers, a medical device used to teach severely disabled people how to walk, no walkers on the market support the users weight with armrests.

The next issue identified in testing existing walkers were the wheels. Existing walkers can be tripped up by small obstacles like rugs, cords, cracks in the ground or doorsills. To solve this, the present invention took inspiration from military airless tires which use flexible structures inside the wheels to absorb and pass over obstacles. The present invention adapted this technology to be used with flexible rubber wheels that are the same size as traditional walker wheels, but can overcome a wide range of obstacles without hesitation. These wheels are vital to offering a smooth walking experience while using the improved mobility assistant apparatus. No other walker on the market has wheels that offer the same benefits as the wheels created for the improved mobility assistant apparatus 20.

The improved mobility assistant apparatus 20 increases stability and comfort for the user. While using the improved mobility assistant apparatus 20, the user stands centered inside of the four wheels 50, increasing stability in all directions. The armrests 22 of the improved mobility assistant apparatus 20 allow the user to distribute their weight throughout their forearms making it more comfortable for the user to place more weight on the improved mobility assistant apparatus 20 which in turn helps the user feel more balanced. The armrests 22 also encourage better posture. The wheels 50 created for the improved mobility assistant apparatus 20 absorb obstacles without hesitation making the improved mobility assistant apparatus 20 much safer and more comfortable to use.

Studies show that active aging helps elderly people live a healthier life by exercising regularly as they age. Walking is a highly effective form of exercise and the improved mobility assistant apparatus 20 allows elderly people to continue walking much later in life. Walking gives elderly people more independence as they can go out to visit friends and family, partake in community events, or simply get out of bed and go to the bathroom by themselves. Research shows that people who go outside every day are much happier and people who are more independent feel better about themselves. The improved mobility assistant apparatus 20 is able to help elderly people be healthier, be more involved, and be more independent.

Other embodiments of the improved mobility assistant apparatus 20 shown in FIGS. 16-25 include at least one accessory from the group of a cup holder 60, a phone holder, a purse hook, a bag, a basket 71, an oxygen tank mount, and the like. The accessory is mounted on the main frame, at the cross bar 26 or down bars 29. As shown in FIGS. 16-20, a cup holder 60 is mounted to the cross bar 26 allowing for a cup 61 to be placed within the cup holder 60. As shown in FIGS. 21-25, a basket 71 is mounted to an attachment 70 which is mounted to the crossbar 26.

The improved mobility assistant apparatus 20 preferably has minimal adjustability which makes for a more consumer friendly product since it is imperative that the walker's frame maintains correct geometry.

The improved mobility assistant apparatus 20 adjusts for various height users.

The improved mobility assistant apparatus 20 preferably includes low profile armrests 22 that are fixed in place.

This low profile armrests 22 allow the user to place their arm where it is most comfortable, instead of having to fit into a certain spot.

The low profile armrests 22 also makes it easier for users to interact with their surroundings, i.e. picking something off of a shelf at the store.

The low profile armrests 22 are preferably fixed at a spot that has been tested to be comfortable for a wide range of people and doesn't require the user to attempt multiple adjustment points.

The improved mobility assistant apparatus 20 preferably includes an ergonomically positioned handgrip.

In one embodiment, the handgrip is turned gently towards the center of the improved mobility assistant apparatus 20.

The handgrips are preferably ergonomically sculpted to be comfortable for a wide range of users, including those with arthritis.

Each armrest 22 is preferably symmetrical forward/back for use in standing or seated position without need to reverse the armrest 22. The armrests 22 are preferably of a minimal thickness height-wise to reduce visual weight from the profile. A dip between armrest and hand grip to allow free motion for wrist. The hand grips are preferably tilted forward for ergonomics. The hand grips may also tilt toward the center of the device for ergonomics. The armrests 22 are height adjustable. The hand grips may flip forward for the walker to temporarily be used as a wheel-chair like device. A brake lever may be integrated into the hand grip with a trigger like mechanism.

Each armrest 22 preferably has a lower area between the armrest 22 and handgrip so that the users wrist bone doesn't contact the armrest 22.

The lowest crossmember of the improved mobility assistant apparatus 20 preferably provides enough clearance to allow users to walk freely without hurting his or her legs by kicking the frame.

The upper crossmember of the improved mobility assistant apparatus 20 preferably extends away from the frame giving the user more space to walk comfortably.

The upper crossmember of the improved mobility assistant apparatus 20 is preferably ergonomically formed and may be padded to create a comfortable backrest when the user is seated.

Each rear leg of the improved mobility assistant apparatus 20 may be fixed in length.

Each rear leg preferably extends away from the frame at an angle close to the ground. This is necessary for collapsibility and is more aesthetically pleasing.

Each rear leg preferably collapses upwards.

This allows for a very compact overall mobility assistant apparatus 20 when placed in the collapsed (folded) position, as shown in FIGS. 11-15.

The improved mobility assistant apparatus 20 preferably uses a unique push-button lock mechanism for folding, which is safer and easier for the user to actuate. It is also more aesthetically pleasing.

The frame of the mobility assistant apparatus 20 preferably extends forward to support its front caster, which was tested and proven to makes it easier for the user to walk without tripping over the wheels 50. The extended front caster also provides more forward stability for the mobility assistant apparatus 20.

The top cross member of the frame preferably extends forward to act as the backrest for the user. The crossmember may be padded for the user's comfort. The lower portion of the frame is open to allow for free motion of the user's legs when walking. The seat 28 preferably acts as the secondary crossmember. In one instance, a secondary crossmember is located near where the seat pivots. The frame extends forward near the bottom in order for the front casters to be located farther from the user's feet. The frame allows the user to stand in an area between or forward of the rear wheels. The frame may be constructed a composite material. The frame may be constructed in aluminum, steel or a similar material.

As shown in FIGS. 7-10, the seat 28 folds down using unique brackets that allow for the most comfortable seated position. The seat brackets of the mobility assistance apparatus 20 are preferably of a unique shape which allows the seat to stow in a higher position than when in use. The seat brackets are preferably of a unique shape which allows the seat to extend farther forward than its pivot point when in the seated position. The seat brackets unique shape allows them to register against the frame when in the seated position for maximum strength.

The seat 28 may consist of a structural frame and expanded mesh, similar to some office chairs, for maximum comfort. The seat 28 may be constructed from stretch-mesh which reduces lower back-pain common in elderly users. The stretch mesh also reduces the visual weight of the mobility assistance apparatus 20. The seat may be constructed in standard upholstery methods common on walkers, while still mounted to the unique seat brackets.

The seat height, width, and depth have been extensively tested and are thoughtfully positioned.

The seat 28 may telescope in depth for more comfortable ergonomics.

Multidirectional armrests 22, can be used while in the seated position, without the need to twist the armrest 180 degrees.

The rear legs of the mobility assistance apparatus 20 function to mount the rear wheels 50. The apparatus 20 preferably has legs that extend rearward from the frame at an angle relative to the ground. The rear legs have a locking pivot mount which allows them to pivot upward and rest in-line with the frame for compact storage. The rear wheels 50 are mounted outside of the rear legs so that they don't interfere with the frame when the rear legs are in the stowed position. A braking system will preferably mount to the rear legs.

The improved mobility assistant apparatus 20 preferably includes wheels 50 with low impact hexagonal non-pneumatic-tires.

Alternatively, the mobility assistant apparatus 20 uses standard wheels.

The improved mobility assistant apparatus 20 may have an accessory mount on its upper crossmember. This allows users to purchase a wide range of accessories for their needs including a, cupholder, basket, bag, phone mount, oxygen tank mount, etc.

The wheels 50 of the improved mobility assistant apparatus 20 preferably have tires with inner cores that consist of a hexagonal membrane that extends parallel to the axel of the tire and extends out of each side of the wheel such that it is visible.

The tire's inner core flexes perpendicularly to the axle of the wheel which is better for absorbing impact.

The tire may be bonded to the rim using an adhesive.

The tire may use the natural elastomeric tension in the wheel to attach to the rim.

The entire tire may be made of a single material.

The entire tire may be made using co-molding or overmolding to take advantage of properties of various polymers.

The tire preferably relies on compression between the footprint of the tire and the hub to absorb shock from small obstacles (such as cracks in the ground, door sills, cords, rugs, etc).

In one case, the wheel is created for light duty consumer applications.

It may be a narrow wheel designed for direct replacement on light-duty equipment like a walker, suitcases, strollers, yard equipment, shopping carts, etc.

The wheel may be designed for custom applications on light-duty equipment.

In one embodiment, increasing or varying wall-thickness in web of non-pneumatic tire, allows for variable compression rate in tire.

The tire may have an arced crown on wheel for low rolling resistance under low force, increases compression in center of wheel (important for narrow applications), curved edges reduce wear on the tire, curved edges make turning easier.

The wheel may have a molded in tread pattern.

The tire may have increased compression in the center of the wheel draft on mold, creates a thicker inner cross-section of the tire, leading to increased compression ratio in center of wheel, arced crown on wheel focuses forces on center of the tire.

In another embodiment, a thicker outer 'wear' layer is molded into tire. In one embodiment, this could be co-molded for increased wear resistance and decreased rolling resistance.

The inner web of each tire preferably consists of polygonal reliefs offset from each other over multiple layers in a radially symmetric pattern to create a web which naturally compresses to absorb shock from obstacles.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes modification and substitutions of equivalents may be made therein without departing from the spirit and scope of this invention which is intended to be unlimited by the foregoing except as may appear in the following appended claim. Therefore, the embodiments of the invention in which an exclusive property or privilege is claimed are defined in the following appended claims.

We claim as our invention the following:

1. A collapsible mobile apparatus comprising a frame comprising a first adjustable bar, a second adjustable bar, a first rear bar, a second bar, a first receiver with a fork, a second receiver with a fork, a crossbar, a first arm rest and a second arm rest, wherein the first rear bar is at an upward angle relative to the ground, wherein the second rear bar is parallel to the first rear bar, wherein the first adjustable bar is connected to the first rear bar and extends upward substantially perpendicular to the first rear bar, wherein the second adjustable bar is connected to the second rear bar and extends upward substantially perpendicular to the second rear bar, wherein the first arm rest is connected at a top end of the first adjustable bar and is substantially parallel to the ground, wherein the second arm rest is connected at a top end of the second adjustable bar and is substantially parallel to the ground, wherein the first receiver is connected to and forward of the first adjustable bar and the second receiver is connected to and forward of the second adjustable bar; and a plurality of wheel assemblies comprising a first wheel assembly, a second wheel assembly, a third wheel assembly and a fourth wheel assembly, each of the plurality of wheel assemblies comprising a hub and a low impact tire, the first wheel assembly connected to the fork of the first receiver, the second wheel assembly connected to the fork of the second receiver, the third wheel assembly mounted on an outer side at a rear end of the first rear bar and the fourth wheel assembly mounted on an outer side at a rear end of second rear bar, wherein the first receiver and the second receiver are substantially parallel to the ground, wherein the first receiver and the second receiver provide stability for a user;

wherein the first rear bar collapses upward and rest in-line with the first adjustable bar and the second rear bar collapses upward and rest in-line with the second adjustable bar and the third wheel assembly is outside of the first rear bear in a collapse position and the fourth wheel assembly is outside of the second rear bear in a collapse position.

2. A collapsible mobile apparatus comprising a frame comprising a first adjustable bar, a second adjustable bar, a first rear bar, a second bar, a first receiver with a fork, a second receiver with a fork, a crossbar, a first arm rest and a second arm rest, wherein the first rear bar is at an upward angle relative to the ground, wherein the second rear bar is parallel to the first rear bar, wherein the first adjustable bar is connected to the first rear bar and extends upward substantially perpendicular to the first rear bar, wherein the second adjustable bar is connected to the second rear bar and extends upward substantially perpendicular to the second rear bar, wherein the first arm rest is connected at a top end of the first adjustable bar and is substantially parallel to the ground, wherein the second arm rest is connected at a top end of the second adjustable bar and is substantially parallel to the ground, wherein the first receiver is connected to and forward of the first adjustable bar and the second receiver is connected to and forward of the second adjustable bar; and a plurality of wheel assemblies comprising a first wheel assembly, a second wheel assembly, a third wheel assembly and a fourth wheel assembly, each of the plurality of wheel assemblies comprising a hub and a low impact tire, the first wheel assembly connected to the fork of the first receiver, the second wheel assembly connected to the fork of the second receiver, the third wheel assembly mounted on an outer side at a rear end of the first rear bar and the fourth wheel assembly mounted on an outer side at a rear end of second rear bar, wherein the first receiver and the second receiver are substantially parallel to the ground, wherein the first receiver and the second receiver provide stability for a user, wherein a diameter of each of the low impact tire of the first wheel assembly, the second wheel assembly, the tire wheel assembly and the fourth wheel assembly is approximately 7 inches;

wherein a height between a first wheel assembly and a first arm rest ranges from 28 inches to 44 inches;

wherein the first rear bar collapses upward and rest in-line with the first adjustable bar and the second rear bar collapses upward and rest in-line with the second adjustable bar and the third wheel assembly is outside of the first rear bear in a collapse position and the fourth wheel assembly is outside of the second rear bear in a collapse position.

3. The collapsible mobility assistance apparatus according to claim 2 wherein the low impact tire of each of the plurality of wheel assemblies is airless.

4. The collapsible mobility assistance apparatus according to claim 2 further comprising a brake assembly comprising a first brake handle connected to a brake for the third wheel assembly and a second brake handle connected to a brake for the fourth wheel assembly.

5. The mobility assistance apparatus according to claim 2 wherein the first rear bar is approximately 19 inches from the second rear bar.

6. The mobility assistance apparatus according to claim 2 wherein a height between a first wheel assembly and a first arm rest ranges from 28 inches to 44 inches.

* * * * *